US005263590A

United States Patent [19]

Olivier

[11] Patent Number: 5,263,590

[45] Date of Patent: Nov. 23, 1993

[54] HEAVY MEDIA SEPARATION PROCESS AND APPARATUS THEREFOR

[76] Inventor: Paul A. Olivier, Kortemarkstraat 159, B-8610 Handzame, Belgium

[21] Appl. No.: 756,657

[22] Filed: Sep. 9, 1991

[51] Int. Cl.[5] ..... B03B 5/30

[52] U.S. Cl. ..... 209/172.5; 209/3; 209/208; 210/297; 210/519

[58] Field of Search ..... 209/3, 155, 172, 172.5, 209/173, 186, 187, 188, 208, 209, 910; 210/196, 297, 388, 519, 525, 528

[56] References Cited

U.S. PATENT DOCUMENTS

| | | | |
|---|---|---|---|
| 4,260,488 | 4/1981 | Condolias | 210/528 X |
| 4,409,098 | 10/1983 | Burke | 209/172.5 |
| 4,780,201 | 10/1988 | Keeter et al. | 210/525 X |
| 4,919,807 | 4/1990 | Morton et al. | 210/388 |
| 5,082,572 | 1/1992 | Schmidt | 210/388 X |

FOREIGN PATENT DOCUMENTS

| | | | |
|---|---|---|---|
| 1025352 | 3/1958 | Fed. Rep. of Germany | 209/172.5 |

OTHER PUBLICATIONS

Publication "Ore Dressing Notes" by American Cyanamid Company, Aug. 1943.

*Primary Examiner*—Joseph E. Valenza
*Assistant Examiner*—Tuan Nguyen
*Attorney, Agent, or Firm*—Sughrue, Mion, Zinn, Macpeak & Seas

[57] ABSTRACT

A method and apparatus for making a very precise separation between materials of different specific gravities. A heavy media separation apparatus for separating a heterogeneous mixture of solid particles having different specific gravities, comprising: a device for adding a suspension medium to the heterogeneous mixture, the suspension medium having suspended therein sufficiently fine particles so that the fluid has an average specific gravity intermediate that of the gravities of the particles to be separated; a device for introducing the heterogeneous mixture, to which the suspension medium has been added, half-way down a separatory vessel, in order to separate the heterogeneous mixture into a first fraction having a gravity lower than the gravity of the suspension medium and into a second fraction having a gravity higher than the gravity of the suspension medium, the first fraction floating and the second fraction sinking in the separatory vessel; a device for controlling and regulating vessel rise rates and vessel settling rates within the suspension medium in the separatory vessel so that they have approximately the same value and in such a manner that they exceed the minimal velocities required to maintain a uniform and stable suspension medium but do not exceed the particle rise rates and particle settling rates of the mixture of solid particles differing in specific gravity by one or two points to the third decimal place; and a device for gathering and evacuating float particles at the top and sink particles at the bottom of said suspension medium.

11 Claims, 6 Drawing Sheets

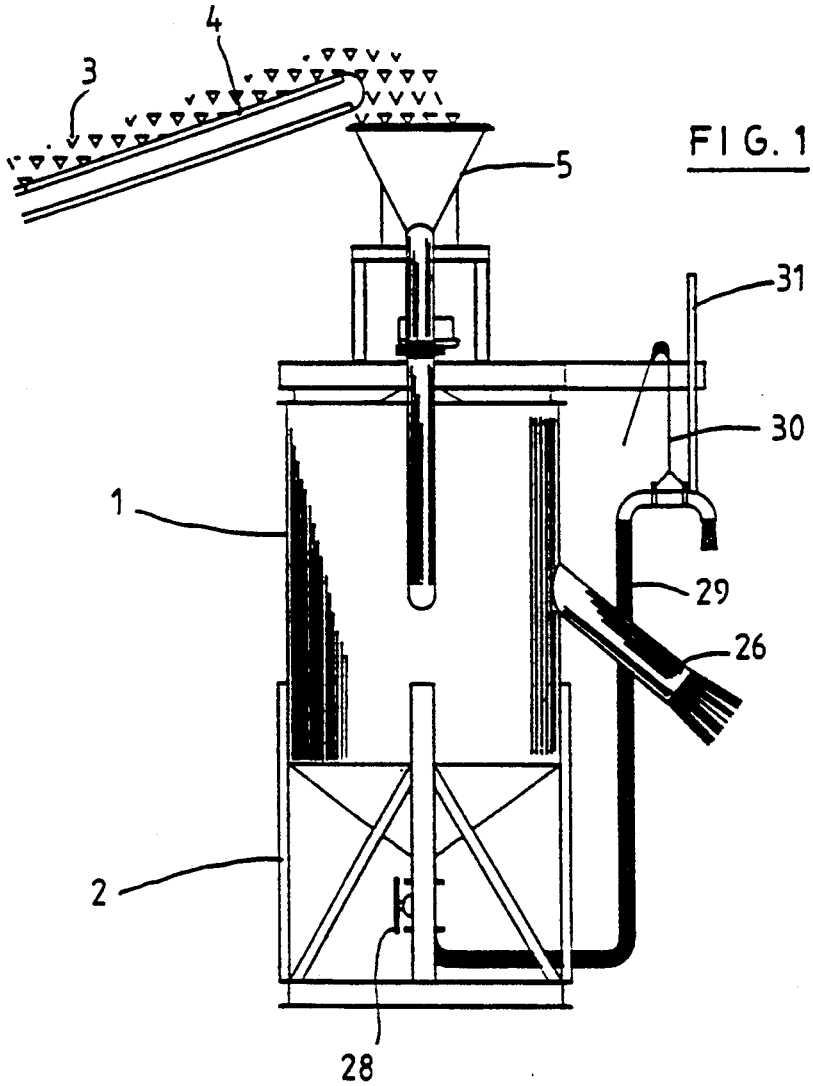
FIG. 1
FIG. 5
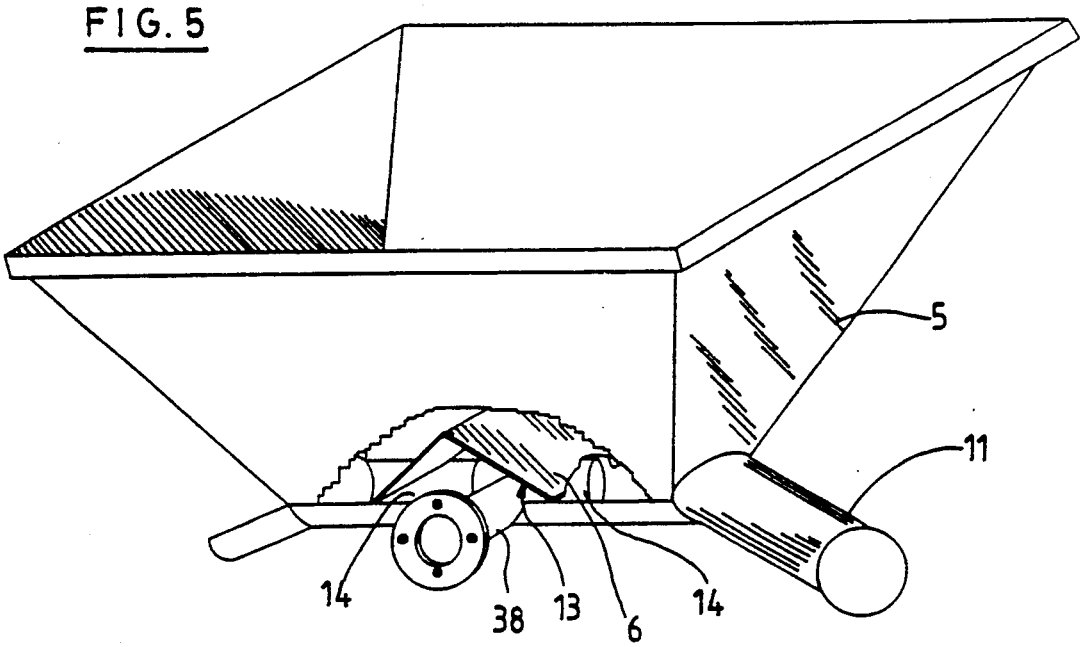

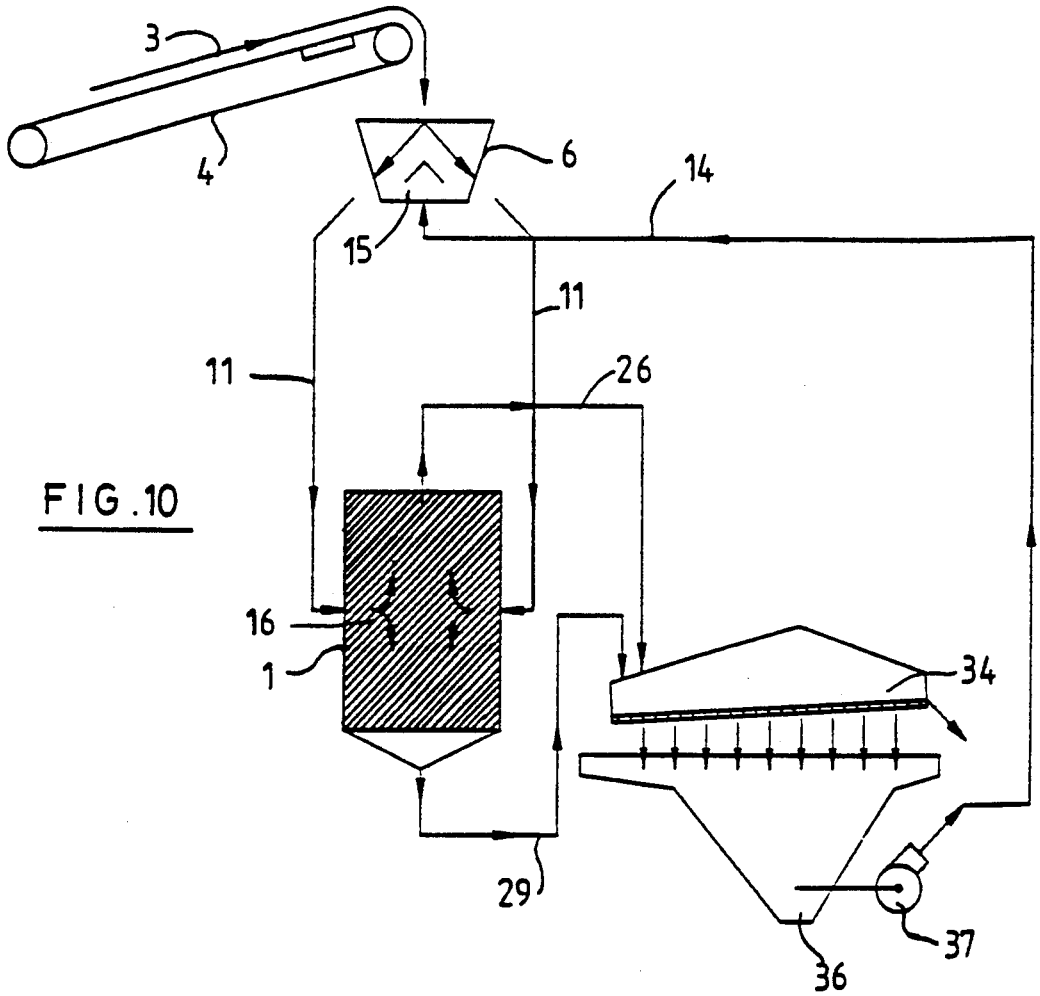
FIG. 10
FIG. 11
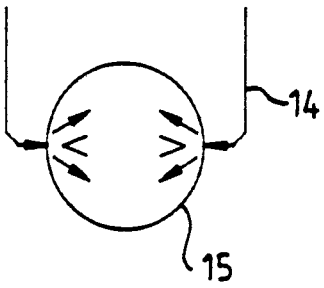
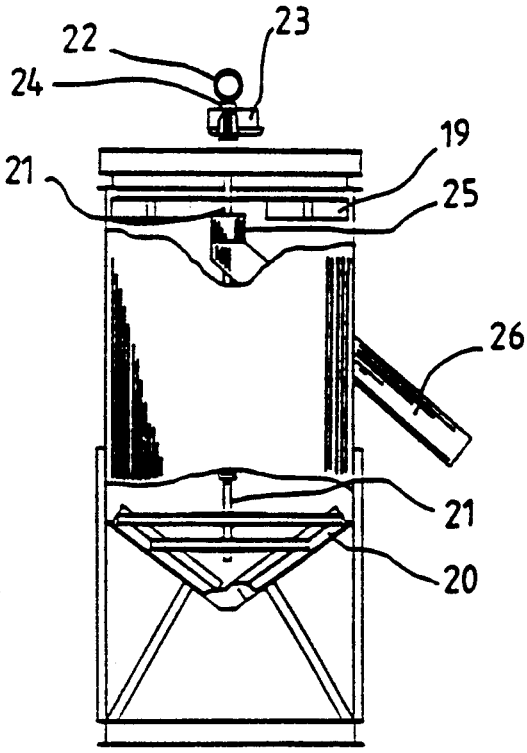
FIG. 12

HEAVY MEDIA SEPARATION PROCESS AND APPARATUS THEREFOR

THE PRIOR ART

Many conventional devices exist to effect density separations. These devices may be classified into two major groups: those employing a dynamic effect, and those employing only a small dynamic effect. The former classification can never be used to make a precise separation involving materials, having very close specific gravities, for example materials differing in specific gravity by only one or two points to the third decimal place, since the dynamic effect can never be controlled uniformly over and against particles of varying sizes and shapes. Whereas the latter classification, generally known as heavy media separation, minimizes considerably the difficulties posed by particle size and shape.

Heavy media separation, in its simplest form, involves a relatively quiescent liquid bath into which the materials to be separated are introduced. Those materials with a density higher than the density of the bath liquid, sink, whereas materials with a density lower than the density of this separating suspending medium, float.

Various separating media having a high specific gravity may be used to effect a separation. The most commonly used liquids on a commercial scale are comprised of colloidal or semi-colloidal solids in suspension in water. Solutions are not viable commercially due to their high cost and their inability to be recycled or disposed of in an environmentally safe manner.

By properly selecting these colloidal solids, suspensions with densities up to 3.2 spg. (specific gravity) can be generated with sufficient liquidity to effect reasonably good separations. This means that, on a large, commercial scale, it has been possible up to now to separate materials which differed in specific gravity by 0.01 to 0.05 of a point. But this "reasonably good" separation accuracy is hardly acceptable within a broad range of industries today where, for example, in highly sophisticated plastic recycling or vegetable quality-grading, much greater accuracy is required.

All heavy media vessels come in three forms according to the basic geometry of a cube, a cylinder, or a cone from which they are derived; that is, rectangular baths, horizontal rotating drums, and separatory cones.

All three of those heavy-media devices generally can be classified as surface separation devices, for they involve a separation at or just below the surface of the separating medium. Since their capacities are all calculated in terms of square surface area available for separation, they may be classified more specifically as two-dimensional surface separation devices. Furthermore, they introduce the feed material at or just below the surface, and they all involve a poorly divided and, therefore, relatively violent introduction of the feed material into the separating zone.

All surface separation devices require a dynamic effect to carry the float particles across the surface of the vessel to some point of overflow or discharge. This dynamic effect can be generated by the forward or outward movement of the separating medium itself as it races to some point of overflow or discharge, as is found, for example, in the technology of the horizontal, scrolled drum or in that of the "Wemco" separatory cone. In every case, however, this dynamic effect disturbs the surface of the bath, and, since the separation takes place in close proximity to the surface, the accuracy of separation is severely undermined.

This problem is further compounded by the violent entry of the feed material into the separating zone. In most cases the feed is introduced via the surface of the vessel at only a single point of entry into the separating zone, thereby creating undesirable laminar turbulence.

Of the three types of heavy media vessels on the market today, perhaps the separatory cone, owing to its large surface area available for separation, is the most accurate in handling slow-settling, small sized, and near-gravity particles. But not only does a cone impose severe constructional limitations since it demands a significant height in order to enlarge the area of the separating zone and to provide sufficient angle needed for the gravity fall of the sinks, but, it also is highly undesirable as a separating instrument in that the vessel rise rates and vessel settling rates within a cone are at no point the same. Without uniform vessel rise rates and settling rates, all possibilities of a truly accurate separation is forfeited.

The object of the present invention is accomplished by a radical departure from the three types of heavy-media vessels mentioned above. In the place of a rectangular bath, a horizontal scrolled drum, or a separatory cone, we propose a vertical separatory cylinder.

So, there remains today the need for a device which does not separate anywhere near the surface of medium, which employs a dynamic effect no greater than that required to assure the uniformity and stability of the suspension medium, which distributes this negligible dynamic effect very evenly over the entire separating zone of the apparatus, which distributes and introduces the incoming feed evenly and gently into the separating zone with as little turbulence as possible, and which evacuates the float and sink particles efficiently in relatively large tonnages far away from the separation zone without in any way placing in jeopardy the accuracy of separation. There remains the need for a process and/or suitable apparatus capable of effecting an extremely precise separation on a broad range of materials which differ ever so little in specific gravity and which must be separated in a simple and cost-effective way on an industrial and commercial scale.

SUMMARY OF THE INVENTION

The present invention relates to the separation of heterogeneous mixtures of solid particles having different densities and puts forward a process which effects this separation with a very high degree of precision. The apparatus of the invention allows for a highly accurate separation between two or more solids of different yet possible very close specific gravities, each of which is present over a broad range of sizes. More specifically, it is a heavy media separation apparatus wherein the flows of solids and media are controlled in such a manner as to allow for a very high degree of accuracy in the separation of materials which normally are considered very difficult to separate due to their shape, size, and/or specific gravity.

It is the object of the present invention to provide an apparatus and a process for performing a heavy media separation with a very high degree of precision, thereby eliminating the problems of the above mentioned prior art. This means to make separations with precision on materials which differ in specific gravity by as little as 0.001 to 0.002 of a point. The present invention assures a uniformity of vessel rise rates and settling rates, and it offers, therefore, a much higher degree of precision than is available in a separatory cone or the other two vessels mentioned above. The terms "vessel rise rate" and "vessel settling rate" will be explained fully in due course.

The present invention proposes a heavy media separation process for separating a heterogeneous mixture of solid particles having different specific gravities, comprising the following steps: adding a suspension medium to said heterogeneous mixture, said suspension medium having suspended therein sufficiently fine particles so that said fluid has an average specific gravity intermediate that of the gravity of the particles to be separated; introducing the said heterogeneous mixture to which said suspension medium has been added, half-way down a separatory vessel, in order to separate said heterogeneous mixture into a first fraction having a gravity lower than the gravity of said suspension medium and into a second fraction having a gravity higher than the gravity of said suspension medium, the first fraction floating and the second fraction sinking in said separatory vessel; controlling and regulating vessel rise rates and vessel settling rates within said suspension medium in said separatory vessel so that they have approximately the same value and in such a manner that they only exceed the minimal velocities required to maintain a uniform and stable suspension medium and do not exceed the particles rise rates and particles settling rates of the heterogeneous mixture of solid particles differing in specific gravity by one or two points to the third decimal place; gathering and evacuating float particles at the top and sink particles at the bottom of said suspension medium.

The apparatus of the present invention comprises a heavy media separation apparatus for separating a heterogeneous mixture of solid particles having different specific gravities, comprising: means for adding a suspension medium to said heterogeneous mixture, said suspension medium having suspended therein sufficiently fine particles so that said fluid has an average specific gravity intermediate that of the gravity of the particles to be separated; means for introducing the said heterogeneous mixture to which said suspension medium has been added, half-way down a separtory vessel, in order to separate said heterogeneous mixture into a first fraction having a gravity lower than the gravity of said suspension medium and into a second fraction having a gravity higher than the gravity of said suspension medium, the first fraction floating and the second fraction sinking in said separatory vessel; means for controlling and regulating vessel rise rates and vessel settling rates within said suspension medium in said separatory vessel so that they have approximately the same value and in such a manner that they only exceed the minimal velocities required to maintain a uniform and stable suspension medium and do not exceed the particle rise rates and particle settling rates the mixture of solid particles differing in specific gravity by one or two points to the third decimal place; means for gathering and evacuating float particles at the top and sink particles at the bottom of said suspension medium.

BRIEF DESCRIPTION OF THE DRAWINGS

This invention will be more fully described in conjunction with the accompanying illustration in which:

FIG. 1 is a front view of the apparatus according to the present invention;

FIG. 5 is a perspective view of the dry divider;

FIG. 10 is a flow diagram illustrating the process of the present invention;

FIG. 11 is a top view of the wet divider;

FIG. 12 is a partial interior view of the vertical separatory cylinder;

DESCRIPTION OF A PREFERRED EMBODIMENT

Figure 2:
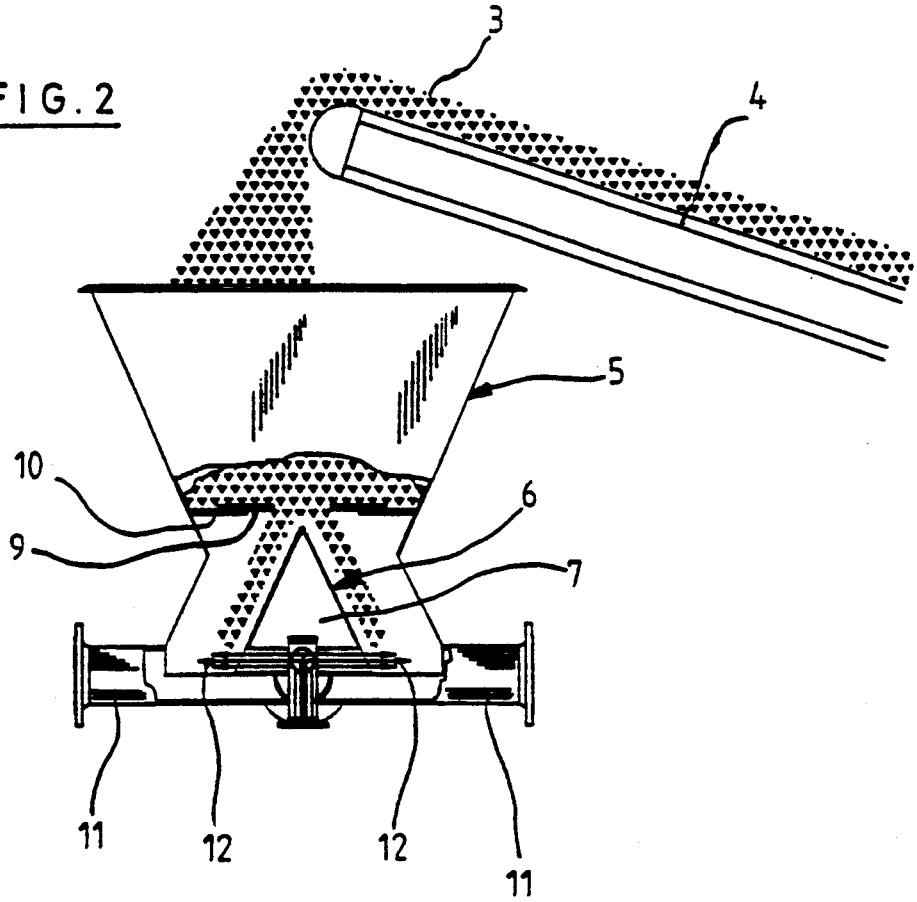
FIG. 2 is a front view of the dry divider.

The process of the present invention is carried out in a separatory vessel which in FIG. 1 is represented by a vertical separatory cylinder 1 which is filled with a heavy media separatory fluid. The vertical separatory cylinder 1 may have a flat bottom, or its bottom may be slightly conical, as is shown in FIG. 1. The vertical separatory cylinder 1 is maintained upright by means of a support frame 2. The dry feed material 3 as shown in FIG. 2 is normally introduced dry into the apparatus by means of a conveyor belt 4. But, in the case of fairly small feed material, it would be possible to pump the solids directly into circuit in the form of a liquid pulp.

However, in most cases, the dry introduction of the feed material is to be preferred, since the ratio of medium to solids within the apparatus can be very carefully controlled. Too much medium relative to dry solids would introduce unnecessary turbulence and dynamic effect within the vessel, thereby disturbing the precision of separation.

Figure 4:
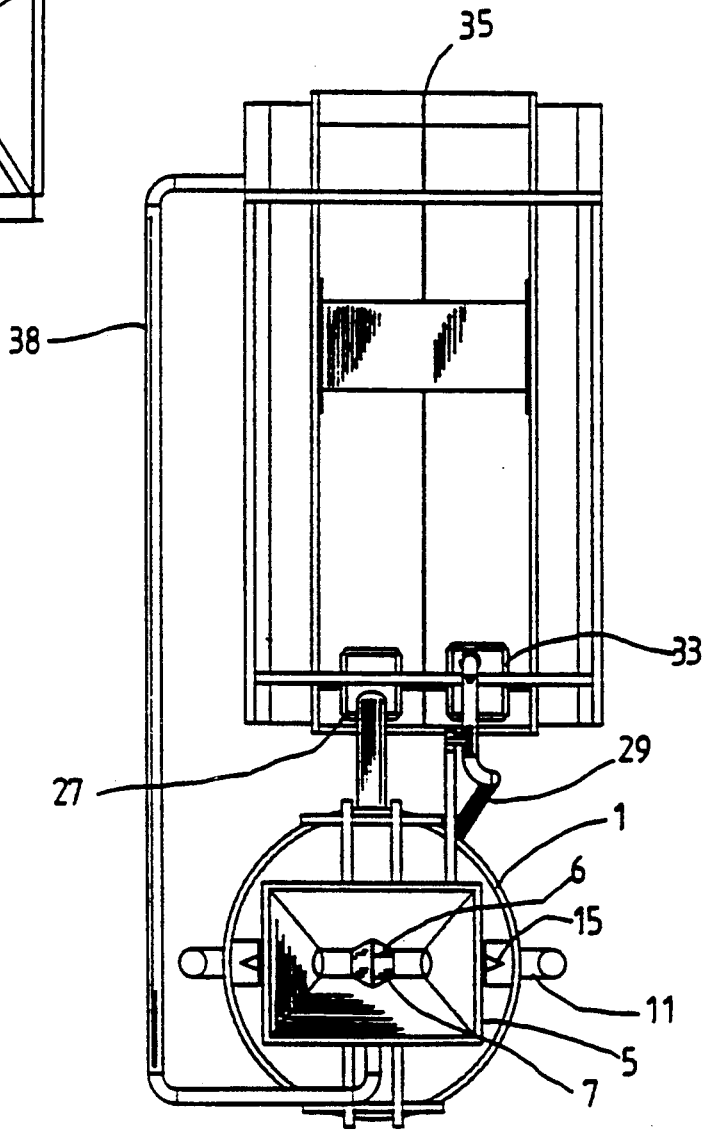
FIG. 4 is a top view of the apparatus with a dewatering device.

The dry feed material 3 falls from the conveyor belt 4 into the feed hopper 5. As shown in FIG. 4, at the bottom of the feed hopper 5 is the dry divider 6. The dry divider 6 splits or divides the incoming dry feed material 3 into two or more parts. The form or design of the dry divider 6 differs according to the number of divisions required.

Figure 3:
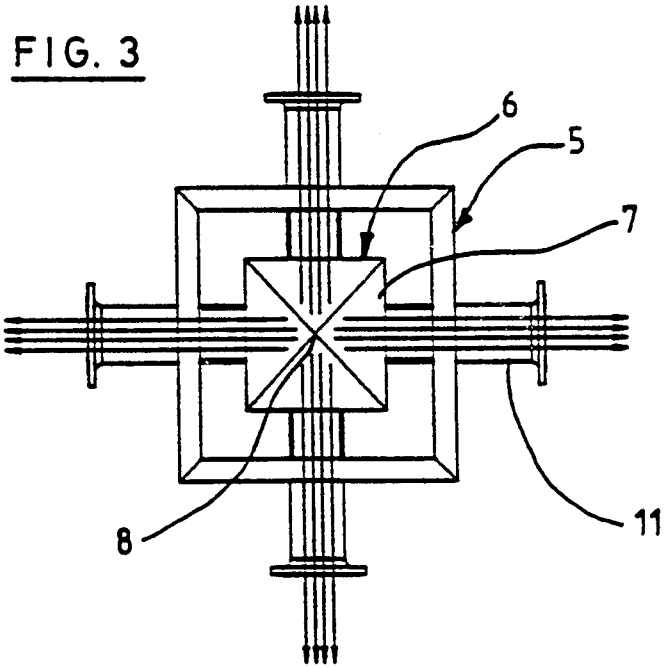
FIG. 3 is a top view of the dry divider shown in FIG. 2.

As shown in greater detail in FIG. 5, the dry divider 6 is an inverted, elongated "V" with two sides when only two divisions of the incoming dry feed material 3 are required. As shown in FIGS. 2 and 3, the dry divider 6 is a "pyramid" with three or more sides when three or more divisions are required. Along the sides of the dry divider 6, the dry feed material 3 falls by gravity and divides into equal parts.

The number of sides 7 to the dry divider 6, as shown in FIG. 3, is determined in the preferred embodiment by the diameter of the vertical separatory cylinder 1. On a minimal basis, there should be, at least, one side 7 to the dry divider 6 per meter of diameter of the vertical separatory cylinder 1: for example, a 2-meter vertical separatory cylinder 1 should have a dry divider 6 with at least two sides, a 3-meter cylinder should have a dry divider 6 with at least three sides, a 4-meter cylinder should have a dry divider 6 with a least four sides, etc. Vertical separatory cylinders 1 of less than 2-meters in diameter should, nevertheless, have a dry divider 6 of at least two sides.

As we have described above, dry dividers 6 with more than two sides 7 take the form of a dry divider pyramid 8 as shown in FIG. 3. In this case, it is important that the dry feed material 3 fed to the dry divider 6 be introduced and centered squarely at the top of the dry divider pyramid 8 so as to assure that the material divides evenly in equal parts along each side 7 of the dry divider pyramid 8. To assure that the incoming dry feed material 3 is guided to a singular point at the top of the dry divider pyramid 8, there is between the feed conveyor belt 4 and the dry divider 6 a feed flow plate 9, as shown in FIG. 2, which discharges its load right at the very top or pinnacle of the dry divider pyramid 8. The feed hopper 5 simply discharges by gravity through the feed flow plates 9 adjustable on the fixed support plates 10, or it may require a vibrating dosing mechanism or some other kind of extractor, depending on the nature of the dry feed material 3 and its dry-flow characteristics.

Figure 6:
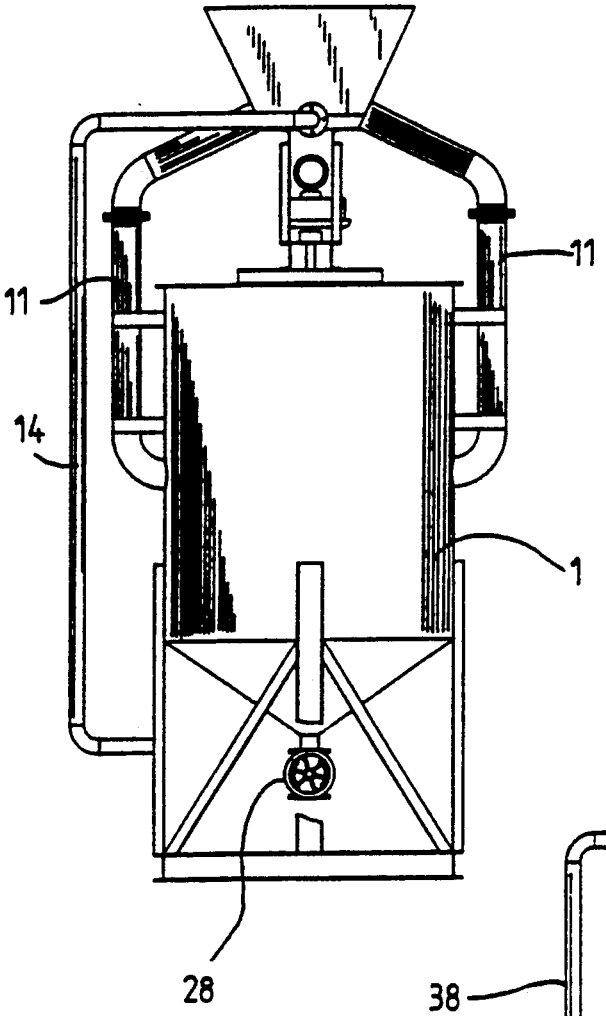
FIG. 6 is a side view of the apparatus.

After the incoming dry feed material 3 roles down the sides of the dry divider 6, it is then propelled into the launder pipes 11 by means of a jet of medium 12 as shown in FIG. 2. Each side 7 of the dry divider 6 has a corresponding jet of medium 12, as shown in FIG. 2, as well as a corresponding launder pipe 11. The launder pipes 11 carry the solid-laden pulp into the vertical separatory cylinder 1 at a point half-way down the suspension medium contained in the vertical separatory cylinder 1 as shown in FIG. 6.

FIG. 5 gives more detail on the design of a two-sided dry divider 6. There we see the inverted, elongated "V" 13 below which is the medium jet feed pipe 14 which splits at right angles into two medium jet feed pipes 14.

FIGS. 2 and 3 give more detail on the design of a four-sided dry divider 6. There we see the dry divider pyramid 8 below which is the medium jet feed pipe 14 which splits into four medium jet feed pipes 14.

Figure 7:
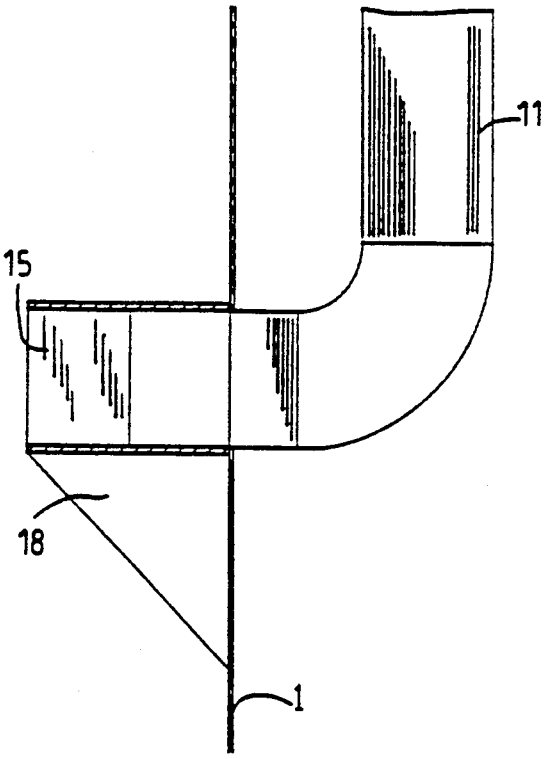
FIG. 7 is a front view of an entrance to the vertical separatory cylinder.

As shown in FIG. 4 and in greater detail in FIG. 7 at the point of entry into the vertical separatory cylinder 1, the feed pulp then encounters a wet divider 15. There the feed pulp from each launder pipe 11 is divided into two equal parts so as to assure the proper spread of the feed solids over as wide an area possible within the three-dimensional separation zone 16 of the vertical separatory cylinder 1. The wet divider 15 as shown in FIG. 4 also breaks the momentum of the incoming feed pulp and assures its calm and gentle introduction into the vessel for an accurate separation.

The diagram in FIG. 10 breaks down the flow within the present invention into its simplest elements.

By means of dry dividers 6 and wet dividers 15, the feed 3 solids in a 2-meter vertical separatory cylinder 1, for example, is divided into four points of entry into the vessel, in a 3-meter vessel into 6 entry points, in a 4-meter vessel into 8 entry points, etc. The material to be separated is uniformly distributed into the three-dimensional separation zone 16 in a quiet and gentle manner.

Figure 8:
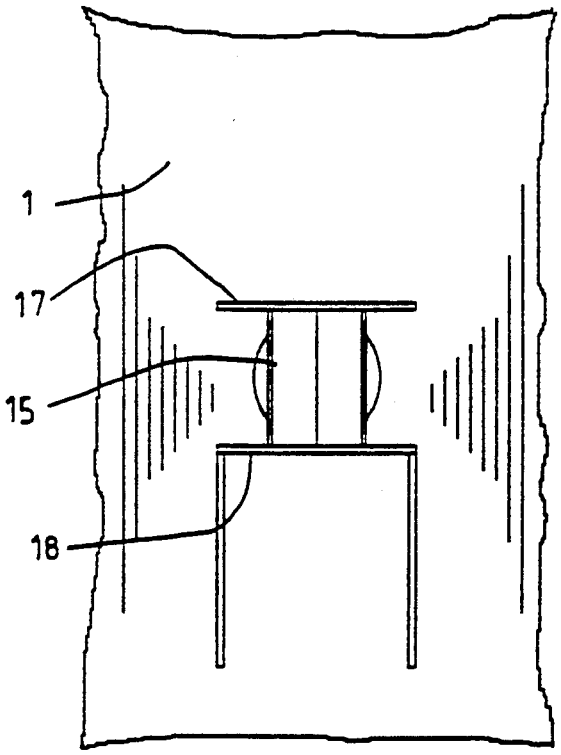
FIG. 8 is a side view of an entrance to the vertical separatory cylinder.
Figure 9:
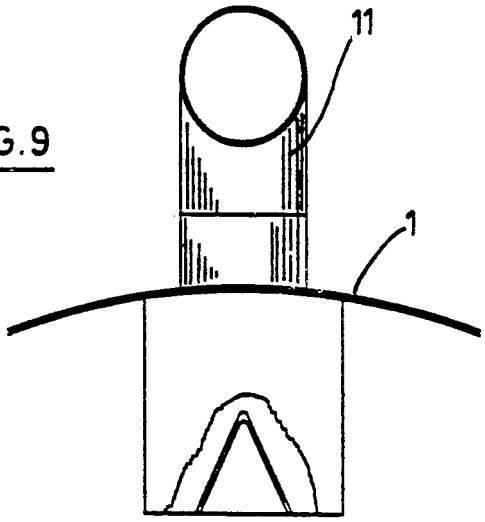
FIG. 9 is a top view of an entrance to the vertical separatory cylinder.

Above and below the wet divider 15, in the form of a "V", in FIGS. 8 and 9, is an upper steel plate 17 and a lower steel plate 18. These two steel plates 17 and 18 assure that the solids to be separated are gently propelled at a right angle to the wall of the vertical separatory cylinder 1 into the three-dimensional separation zone 16.

The fast rising and fast sinking particles quickly break loose from this gentle inward movement toward the center of the vertical separatory cylinder 1, and they report as floats and sinks respectively. The more difficult near-gravity particles continue to move toward the inner, most gentle area of the three-dimensional separation zone 16, there to be subjected to the most precise heavy-media separation possible outside of a laboratory situation.

The separation takes place far from the surface of the vessel, and, in no way can it be understood as a surface separation. The three-dimensional separation zone 16 is fully three-dimensional, as we see in FIG. 10. This three-dimensional aspect implies a considerable increase in the capacity of the vertical separatory vessel 1 relative to vessels of only a two-dimensional surface separation design.

The floats rise to the surface of the vessel, and once they have reached the surface, no further separation is required, and they must simply be evacuated as quickly as possible. Likewise, the sinks descend to the bottom of the vessel, where no further separation is required, and, they, too, must be evacuated as quickly as possible.

As shown in FIG. 12, there are two rakes which assure the quick evacuation of both the floats and sinks: a top floats rake 19 and a bottom sinks rake 20. Both rakes are attached to a common central shaft 21 driven by a common rake motor 22 and a common speed reducer 23. An hydraulic variable speed adjuster 24 may be optionally mounted above the common speed reducer 23.

The top floats rake 19 is designed to orient the floats to a central surface overflow point called the center well 25. Many top rake designs are possible, in view of the nature of the floats being evacuated. Once the floats have been raked to the center of the vessel, the medium overflow height must be sufficient to carry the largest floats over the edge of and into the center well 25.

The diameter of the center well 25 is dependent on several factors, as, for example: the diameter of the vertical separatory cylinder 1, the maximum diameter of the float particles, the quantity of floats gravitating to the center well 25, and the quantity of medium overflowing the center well 25. With all of these factors under consideration, the diameter of the center well 25 should be kept as small as possible so that a minimum of medium is required to report to the center well 25. The amount of medium reporting to overflow determines what is called the vessel rise rate.

The vessel rise rate should be kept as low as possible, for, it, together with the vessel settling rate, plays a most critical role in determining the precision of separation within the vessel. The vessel rise rate and the vessel settling rate should never exceed just a few millimeters per second if extremely accurate separations are required. Since most separatory cones on the market today overflow along their entire external circumference, very large amounts of medium must report to overflow to assure that the largest float particles manage to work their way over the edge and out of the cone. This means that large quantities of overflow medium are required, and, consequently, there is a very high vessel rise rate which destroys all accuracy of separation.

If the settling rate of a near-gravity, theoretical sink particle is less than the vessel rise rate then this theoretical sink particle will incorrectly report to floats. Likewise, if the rise rate of a near-gravity, theoretical float particle is less than the vessel settling rate, then this theoretical float particle will incorrectly report to sinks.

The present invention makes it uniquely possible to reduce vessel rise rates and settling rates to such low levels that it is possible to separate accurately particles whose float and sink velocities are extremely small.

To assure a very accurate separation all dynamic effect in terms of vessel rise rates and vessel settling rates should be uniform throughout the entire vertical separatory cylinder 1. The vessel rise rate should be equal to the vessel settling rate. Therefore half of the medium introduced into the vessel should report to overflow and the other half should report to underflow. The present invention foresees a very simple device to arrive at and maintain a balance between these two flows.

The fact that half of the medium introduced into the vessel reports to overflow and the other half to underflow assures very easily that the medium remains stable and uniform at all points within the three-dimensional separation zone 16. It is not necessary to bring into this invention any special devices to assure the stability and uniformity of the medium, as is so often the case with other vessels on the market today.

Figure 13:
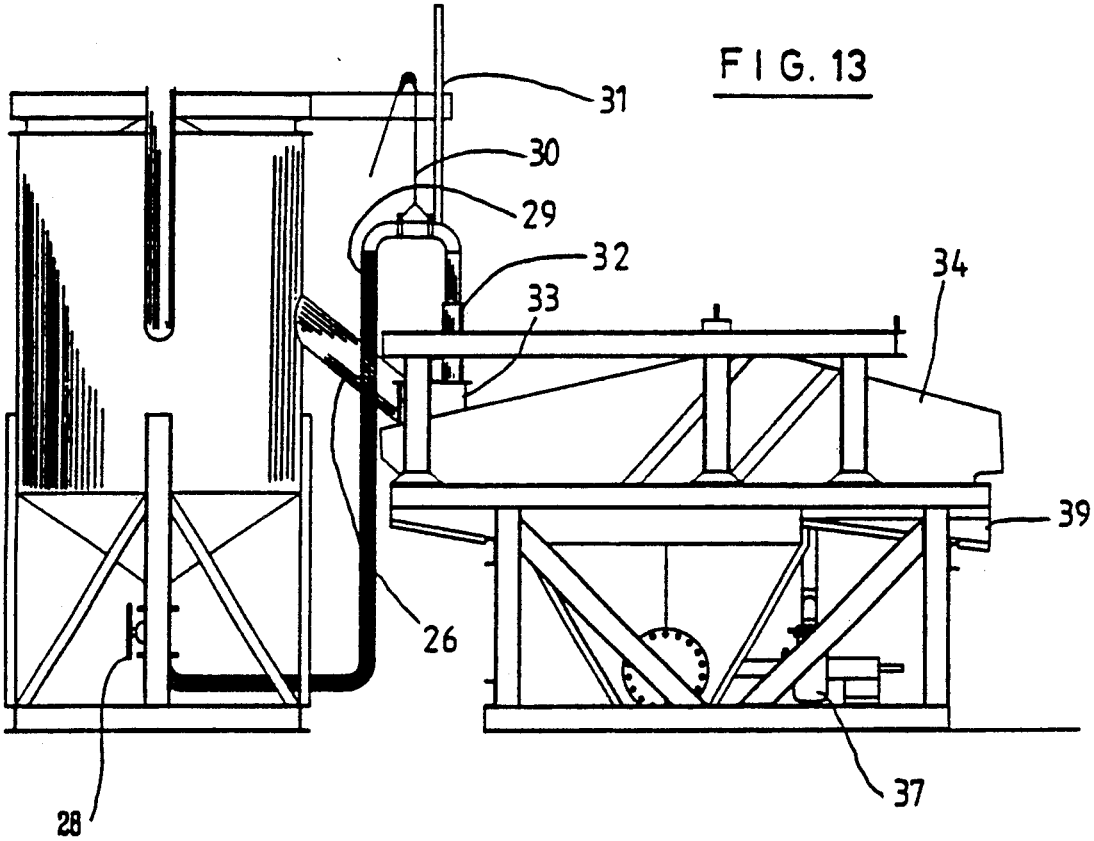
FIG. 13 is front view of the vertical separatory cylinder and a dewatering device.
Figure 14:
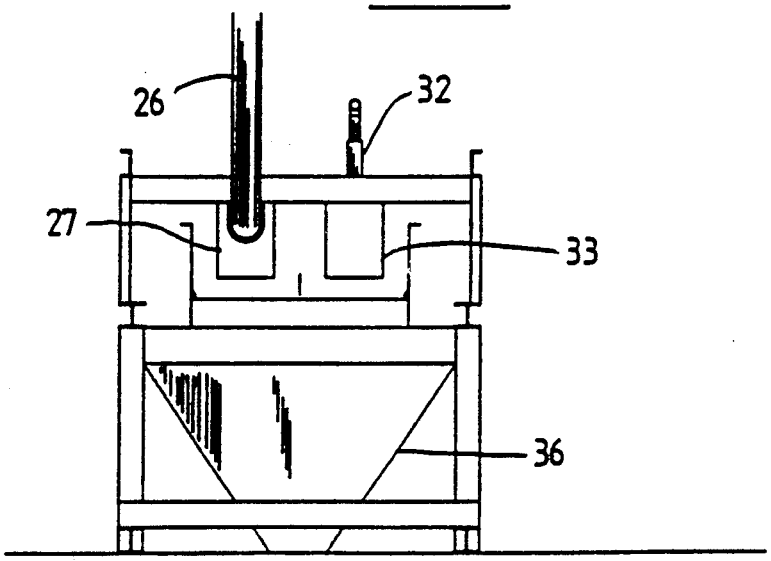
FIG. 14 is a side view of the dewatering device.

The floats overflow the center well 25 and flow down by gravity through the floats evacuation pipe 26. The floats evacuation pipe 26 carries the float pulp outside of the vertical separatory cylinder 1 and onto a solids dewatering and medium filtration device appropriate to the nature of the floats and the medium. As indicated in FIGS. 13 and 14, the preferred solution is that the floats evacuation pipe 26 discharges into the floats splash guard box 27. The preferred solids dewatering and medium filtration device will be described after we have described the sinks evacuation.

The sinks settle to the bottom of the vessel and are gathered to the center for evacuation by the bottom sinks rake 20. Many sink rake designs are possible, in view of the nature of the sinks being evacuated.

Once the sinks have been raked to the center, many means are available to remove them from the separatory vessel: conveyor belts, screws, air-lifts, etc. The evacuation device chosen, in fact, depends on the size, shape, and specific gravity of the sink material. A valve 28, situated at the bottom of the vessel, is useful during start-up and shut-down of the vessel, but, remains completely open during the normal operation of the vessel.

The sink apparatus preferred in this invention is much simpler than all of the above: it is a simple pipe which removes the sinks by means of a gravity flow made possible by means of a difference in height between the overflow level in the vertical separatory cylinder 1 and the somewhat lower level of the discharge end of this flexible sinks extract pipe 29. This simple solution is highly feasible provided that there is a relatively small difference in specific gravity between the float and sink particles. A large difference in specific gravity between the floats and sinks would require a very high limiting settling velocity in the flexible sinks extract pipe 29. This would imply, in turn, a high vessel settling rate which would destroy all accuracy of separation.

Since it is the goal to make separations accurately between particles very close in specific gravity, then a simple flexible sinks extract pipe 29 is sufficient. When the specific gravity of the medium is very close to the specific gravity of the sinks, then very little velocity in the flexible sinks extract pipe 29 is required to evacuate the sinks. This means further that the flexible sinks extract pipe 29 diameter may be relatively large so as to accommodate easily the largest particles present in the sinks. Since the velocity in this large flexible sinks extract pipe 29 is very small, no large quantities of medium are drawn through the pipe thereby increasing deleteriously the vessel settling rate.

The present invention foresees a flexible sinks extract pipe 29 whose outlet is adjustable in height relative to the overflow height of the center well 25 of the vessel. When the discharge end of the flexible sinks extract pipe 29 is on the same level as the overflow height of the center well 25, then, of course, there is no flow whatsoever through the flexible sinks extract pipe 29. As the discharge end of the flexible sinks extract pipe 29 is lowered, a flow is created in proportion to the difference in height between the two levels. By simply adjusting the height of the discharge end of the flexible sinks extract pipe 29, both the quantity of pulp through the flexible sinks extract pipe 29 as well as the velocity of this pulp can be carefully regulated. In this way it is easy to maintain a perfect balance between the overflow and underflow rates in the vessel so that the vessel rise and settling rates remain the same.

The height of the discharge end of the flexible sinks extract pipe 29 could be adjusted in a variety of ways. A flexible sinks extract pipe 29 is foreseen which would be long enough to reach the zero-flow position at the level of the center well 25 overflow. As the discharge end of the flexible sinks extract pipe 29 is raised or lowered the flexible sinks extract pipe 29 would simply bend and flex to follow this movement. The distance over which the flexible sinks extract pipe 29 is adjusted is relative to the difference between the specific gravity of the medium and the specific gravity of the sinks.

Preferably, as indicated in FIGS. 1 and 13, the flexible sinks extract pipe 29 is raised and lowered by means of a rope or steel cord 30 which could be spooled in or out by hand or by means of a hand- or motor-driven winch (not shown). An air-bleed pipe 31 is foreseen to prevent any siphoning effect as the flexible sinks extract pipe 29 discharges into a larger intermediate pipe 32 coming straight down onto some dewatering and filtration device. The flexible sinks extract pipe 29 can simply slide up and down within this larger intermediate pipe 32. Preferably, as indicated in FIGS. 4 and 13, the intermediate pipe 32 discharges into a sinks splash guard box 33.

The floats splash guard box 27 and the sink splash guard box 33 present each their own pulp to a single vibratory dewatering screen 34, as shown in FIG. 13, for solids dewatering and medium filtration. The vibratory dewatering screen 34 is split down the middle over its length, as shown in FIG. 4, with the floats on one side and the sinks on the other. A dewatering screen partition 35 keeps the floats and sinks apart. However, it should be noted that any appropriate solids dewatering and medium filtration device appropriate to the nature of the solids and of the medium would fulfill the requirements.

The first section of the vibratory dewatering screen 34 is devoted to solids dewatering and medium filtration. Under this first section of the vibratory dewatering screen 34 there is a medium tank 36 which collects the underflow of the first section of the vibratory dewatering screen 34. From the medium tank 36 the medium is pumped by means of a medium pump 37 back to the medium jet feed pipe 14, as shown in FIG. 5, via the medium feed pipe 38, as shown in FIGS. 4 and 5. The last section of the vibratory dewatering screen 34 may be used to rinse the two outgoing finished products.

Underneath the rinse section of the vibratory dewatering screen 34 there may be a rinse tank or simply a rinse pan 39 as indicated in FIG. 13. The rinse water from the rinse tank or pan 39 then goes to its appropriate destination.

All of the most important steps in the process have been described in detail. However, additional steps may be added to the process if so desired. For example, it may be necessary to prepare the raw material either by scrubbing, screening, or rinsing prior to introduction into the separatory vessel. It may be necessary to recycle and reclaim the suspension solids out of the rinse water referred to in the previous paragraph. Medium recovery and reuse may be varied according to the nature of the media solids used. It may be necessary to add a water purification or effluent treatment circuit.

EXAMPLE

In January 1991 two days of trials were conducted with a 2-meter separatory cylinder.

Approximately 25 tons per hour of potatoes were fed to the separator. The average diameter of the potatoes was approximately 35 mm. The average length of the potatoes was approximately 70 mm. At an average specific gravity of 1.08, the solids volume of this feed was approximately 23 cubic meters per hour.

The total cubic meters of medium fed to the separator was 117, of which approximately 51 cubic meters of medium reported to overflow and 66 cubic meters of medium reported to underflow. This resulted in a vessel rise rate of 4.53 mm per sec and a vessel settling rate of 5.82 mm per sec. The total volume of both medium and solids fed to the separator was 140 cubic meters per hour.

The sinks extract pipe had an inside diameter of 100 mm. This pipe diameter was carefully chosen so that even the largest potatoes could be evacuated easily. At no time during the trials did the extract pipe block up.

The limiting settling velocity in the sinks pipe was set at 2.3 meter per second, high enough so that any odd stones or heavy objects in the potatoes would be evacuated. This velocity was theoretically high enough so as to evacuate stones of a density of 2.6. But, in the end, no such stones were noted in the sinks. However, there were clay balls of a density of approximately 2.0. Of course, these clay balls discharged quite easily at such a high limiting settling velocity.

The dry colloidal material used to create a slurry suspension was clay. This clay had a dry true density of approximately 2.65. The slurry density chosen for the separation was 1.0788. The potatoes fed to the separator ranged in density from about 1.06 to 1.09. Approximately half of the potatoes reported to floats and the other half reported to sinks. Samples were taken all throughout the trials and controlled for errors. No separation errors could be found at the third decimal place.

We controlled the specific gravity of each of the sampled potatoes. Each potato sampled was dried with a paper towel to remove all surface moisture. Each potato was then weighed in air and then weighed under water. The difference between the two weights gives the volume of the potato. The dry weight in air divided by the volume gives the specific gravity of the sampled potato. The following table, gives typical specific gravities of the floats and the sinks. The table gives the dry weight of the potato in air in grams, the weight in grams of the potato under water, the difference between the two weights (i.e. the volume in milliliters), and finally the specific gravity of each potato. As one can easily observe, there were no separation errors to the third decimal place.

| Sinks at 1.0788 | | | | Floats at 1.0788 | | | |
|---|---|---|---|---|---|---|---|
| In Air | In Water | Diff | SPG | In Air | In Water | Diff | SPG |
| 43.9 | 3.6 | 40.3 | 1.0893 | 63.8 | 4.4 | 59.4 | 1.0741 |
| 54.1 | 4.1 | 50.0 | 1.0820 | 47.9 | 2.8 | 45.1 | 1.0621 |
| 41.6 | 3.1 | 38.5 | 1.0805 | 47.9 | 3.4 | 44.5 | 1.0764 |
| 43.8 | 3.3 | 40.5 | 1.0815 | 49.5 | 3.5 | 46.0 | 1.0761 |
| 57.9 | 4.5 | 53.4 | 1.0843 | 46.5 | 3.0 | 43.5 | 1.0690 |
| 60.3 | 5.1 | 55.2 | 1.0924 | 64.1 | 4.3 | 59.8 | 1.0719 |
| 63.6 | 5.1 | 58.5 | 1.0872 | 65.5 | 4.6 | 60.9 | 1.0755 |
| 50.8 | 4.1 | 46.7 | 1.0878 | 55.9 | 3.7 | 52.2 | 1.0709 |
| 39.9 | 3.1 | 36.8 | 1.0842 | 39.9 | 2.6 | 37.3 | 1.0697 |
| 46.2 | 3.9 | 42.3 | 1.0922 | 40.0 | 2.6 | 37.4 | 1.0695 |
| 45.8 | 3.7 | 42.1 | 1.0879 | 64.1 | 4.6 | 59.5 | 1.0773 |
| 59.0 | 4.3 | 54.7 | 1.0786 | 49.7 | 3.6 | 46.1 | 1.0781 |
| 62.9 | 5.1 | 57.8 | 1.0882 | 45.4 | 3.2 | 42.2 | 1.0758 |
| 47.5 | 4.0 | 43.5 | 1.0920 | 62.2 | 4.4 | 57.8 | 1.0761 |
| 42.9 | 3.2 | 39.7 | 1.0806 | 69.7 | 4.9 | 64.8 | 1.0756 |
| 57.0 | 4.2 | 52.8 | 1.0795 | 57.5 | 4.2 | 53.3 | 1.0788 |

What I claim is:

1. Heavy media separation process for separating a heterogeneous mixture of solid particles having different specific gravities, comprising the steps of:

adding a suspension medium to said heterogeneous mixture, said suspension medium having suspended therein sufficiently fine particles so that said medium has an average specific gravity intermediate that of the gravities of the particles to be separated;

introducing said suspension medium with the added heterogeneous mixture into a vessel wherein a first part of said medium rises at a vessel rise rate while the remaining part of said medium settles at a vessel settling rate, and wherein a first part of the mixture rises so as to form float particles while the remaining part of the mixture settles so as to form sink particles;

evacuating the float particles together with medium at the top of the suspension medium;

evacuating the sink particles together with medium at the bottom of the suspension medium; and regulating the vessel rise rate of the medium into the vessel, as well as the vessel settling rate of the medium into the vessel, (1) so as to be greater than the minimal velocities of the medium for maintaining a stable suspension medium to ensure the stability and uniformity of the medium, and (2) so as to be lower than the rise rate or settling rate of a solid particle of the heterogeneous mixture different in specific gravity from the average specific gravity of the medium by less than 0.002 of a point.

2. Heavy media separation process according to claim 1, in which the heterogeneous mixture to which said suspension has been added is introduced half way down the vessel.

3. Heavy media separation process according to claim 1, in which the sink particles, together with medium, is evacuated through a sinks evacuation pipe, the level of which, relative to the level of evacuation of the float particles from the vessel, is regulated so as to control and to regulate the vessel rise rate and the vessel settling rate.

4. Heavy media separation apparatus for separating a heterogeneous mixture of solid particles having different specific gravities, said apparatus comprising:

a) means for adding a suspension medium to said heterogeneous mixture, said suspension medium having suspended therein sufficiently fine particles so that said medium has an average specific gravity intermediate that of the gravities of the particles to be separated;

b) a vessel provided with means for introducing therein the heterogeneous mixture with the added suspension medium, so that in said vessel, on the one hand, a first part of said medium rises at a vessel rise rate while the remaining part of said medium settles at a vessel setting rate, and on the other hand a first part of the mixture rises to form float particles while the remaining part of the mixture settles to form sink particles;

c) means for gathering and evacuating the float particles together with medium at the top of the suspension medium;

d) means for gathering and evacuating the sink particles together with medium at the bottom of the suspension medium; and e) means for controlling and regulating the vessel rate of the medium into the vessel so that the vessel rise rate of the medium into the vessel, as well as the vessel settling rate of the medium into the vessel, is greater than the minimal velocities of the medium for maintaining a stable suspension medium so as to ensure the stability and uniformity of the medium, and so that both the vessel rise rate of the medium into the vessel and also the vessel settling rate of the medium into the vessel are lower than the rise rate or settling rate of a solid particle of the heterogeneous mixture differing in specific gravity from the average specific gravity of the medium by less than 0.002 of a point.

5. Heavy media separation apparatus according to claim 4, in which the means for introducing into the vessel the heterogeneous mixture with the added suspension medium are launder pipes, the outlet of which in the vessel is half-way down the vessel.

6. Heavy media separation apparatus according to claim 4, in which the means for gathering and evacuating the float particles together with medium comprises a center well located in the vessel, and a float rake to orient float particles towards the center wall.

7. Heavy media separation apparatus according to claim 4, in which the means for gathering and evacuating the float particles together with the medium comprises a center well located in the vessel and a float rake to orient float particles towards the center well, in which the means for gathering and evacuating the sinks particles together with medium comprises a central underflow evacuation located at the bottom of the vessel, and a sink rake to orient the sinks towards the central underflow evacuation, and in which the float rake and the sink rake are attached to a common shaft driven by a motor and a speed reducer.

8. Heavy media separation apparatus for separating a heterogeneous mixture of solid particles having different specific gravities, said apparatus comprising:

a) means for adding a suspension medium to said heterogeneous mixture, said suspension medium having suspended therein sufficiently fine particles so that said medium has an average specific gravity intermediate that of the gravities of the particles to be separated;

b) a vessel provided with means for introducing therein the heterogeneous mixture with the added suspension medium, so that in said vessel, on the one hand, a first part of said medium rises at a vessel rise rate while the remaining part of aid medium settles at a vessel settling rate, and on the other hand a first part of the mixture rises so as to form float particles while the remaining part of the mixture settles so as to form sink particles;

c) means for gathering and evacuating the float particles together with medium at the top of the suspension medium, said last-mentioned means comprising a center well located at a level in the vessel;

d) means for gathering and evacuating the sink particles together with medium at the bottom of the suspension medium, said last-mentioned means comprising a sinks extract pipe with an outlet; and e) means for controlling and regulating the vessel rate of the medium into the vessel so that the vessel rise rate of the medium into the vessel, as well as the vessel settling rate of the medium into the vessel, is greater than the minimal velocities of the medium for maintaining a stable suspension medium so as to ensure the stability and uniformity of the medium, and so that both the vessel rise rate of the medium into the vessel and also the vessel settling rate of the medium into the vessel are lower than the rise rate or settling rate of a solid particle of the heterogeneous mixture differing in specific gravity from the average specific gravity of the medium by less than 0.002 of a point, said controlling and regulating means also adjusting in height the outlet of the sinks extract pipe relative to the level of the center well.

9. Heavy media separation apparatus according to claim 8, in which the means for introducing into the vessel the heterogeneous mixture with the added suspension medium are launder pipes, the outlet of which in the vessel is half-way down the vessel.

10. Heavy media separation apparatus according to claim 8, in which the means for gathering and evacuating the float particles together with medium comprises a float rake to orient float particles towards the center well.

11. Heavy media separation apparatus according to claim 8, in which the means for gathering and evacuating the float particles together with medium comprises a float rake to orient float particles towards the center well, in which the means for gathering and evacuating the sinks particles together with medium comprises a central underflow evacuation located at the bottom of the vessel and a sink rake to orient the sinks towards the central underflow evacuation, and in which the float rake and the sink rake are attached to a common shaft driven by a motor and a speed reducer.

* * * * *